US006530357B1

(12) United States Patent
Yaroshenko

(10) Patent No.: US 6,530,357 B1
(45) Date of Patent: Mar. 11, 2003

(54) ROTARY INTERNAL COMBUSTION ENGINE

(76) Inventor: Viktor Prokoflevich Yaroshenko, 93 Renzavodskaya Str., Apt. 10, Apostolovo 322459 (UA)

( * ) Notice: Subject to any disclaimer, the term of this patent is extended or adjusted under 35 U.S.C. 154(b) by 0 days.

(21) Appl. No.: 09/831,660

(22) PCT Filed: Nov. 17, 1999

(86) PCT No.: PCT/UA99/00026

§ 371 (c)(1),
(2), (4) Date: Jul. 27, 2001

(87) PCT Pub. No.: WO00/34636

PCT Pub. Date: Jun. 15, 2000

(30) Foreign Application Priority Data

Nov. 18, 1998 (RU) ..... 98116105

(51) Int. Cl.[7] ..... F02B 53/00

(52) U.S. Cl. ..... 123/244; 123/228; 123/242; 123/229; 418/248; 418/91

(58) Field of Search ..... 123/243, 228, 123/229, 244; 418/248, 247, 243, 61.3, 91

(56) References Cited

U.S. PATENT DOCUMENTS 1,850,833 A * 3/1932 Erny ..... 123/228
2,786,421 A * 3/1957 Prendergast ..... 418/248
3,193,186 A * 7/1965 Peras ..... 418/61.3
3,251,348 A * 5/1966 Unruh ..... 123/228
3,276,386 A * 10/1966 Fanshawe ..... 418/248
3,280,804 A * 10/1966 Hellbaum ..... 123/228
3,303,830 A * 2/1967 Fingeroot et al. ..... 418/91
3,797,464 A * 3/1974 Abbey ..... 123/229
3,883,276 A * 5/1975 Hofbauer ..... 123/242
4,089,305 A * 5/1978 Gregg ..... 123/244
4,115,045 A * 9/1978 Wyman ..... 418/248
4,599,059 A * 7/1986 Hsu ..... 418/248
5,372,107 A * 12/1994 Smythe ..... 123/244
5,989,002 A * 11/1999 Nied-Menninger ..... 418/248
6,241,499 B1 * 6/2001 Stigebrandt ..... 418/248

* cited by examiner

*Primary Examiner*—Thomas Denion
*Assistant Examiner*—Thai-Ba Trieu
(74) *Attorney, Agent, or Firm*—Rabin & Berdo, P.C.

(57) ABSTRACT

The present invention pertains to rotary internal combustion engines and essentially relates to an engine including a body that comprises an inner cylindrical cavity as well as side covers. The cavity comprises a rotor-piston which is concentrically mounted therein, which comprises side surfaces, radial protrusions and radial recesses on its peripheral surface, and which forms together with the body a plurality of segmented cavities. The side surfaces of the rotor-piston abut tightly with the side covers, while the radial protrusions at the peripheral surface of the rotor-piston abut tightly with the inner cylindrical surface of the body cavity. The combustion chamber is located beyond the limits of the inner cylindrical cavity and communicates with the latter through inlet and outlet channels provided with controlled slide valves. This engine also includes discharge and supply channels as well as separation vanes which are mounted so as to be capable of radial displacement in the grooves of the body and of the inner surfaces of the side covers between the inlet and outlet channels of the combustion chambers as well as between the discharge and supply channels. The separation vanes are connected to a control mechanism, are brought into contact with the peripheral surface of the rotor-piston and define together with the radial recesses of the rotor-piston, with the inner surface of the cylindrical body and with the side covers of the body a plurality of segmented working chambers. This engine is characterised in that it further includes a second combustion chamber which is identical to the first one and is isolated therefrom. The first combustion chamber communicates with the inner cylindrical cavity of the body through a first inlet channel and a first outlet channel provided with controlled slide valves, while the second combustion chamber communicates with the inner cylindrical cavity of the body through a second inlet channel and a second outlet channel also provided with controlled slide valves. This engine has a high specific output as well as a regular torque.

3 Claims, 2 Drawing Sheets

ROTARY INTERNAL COMBUSTION ENGINE

Figure 1:
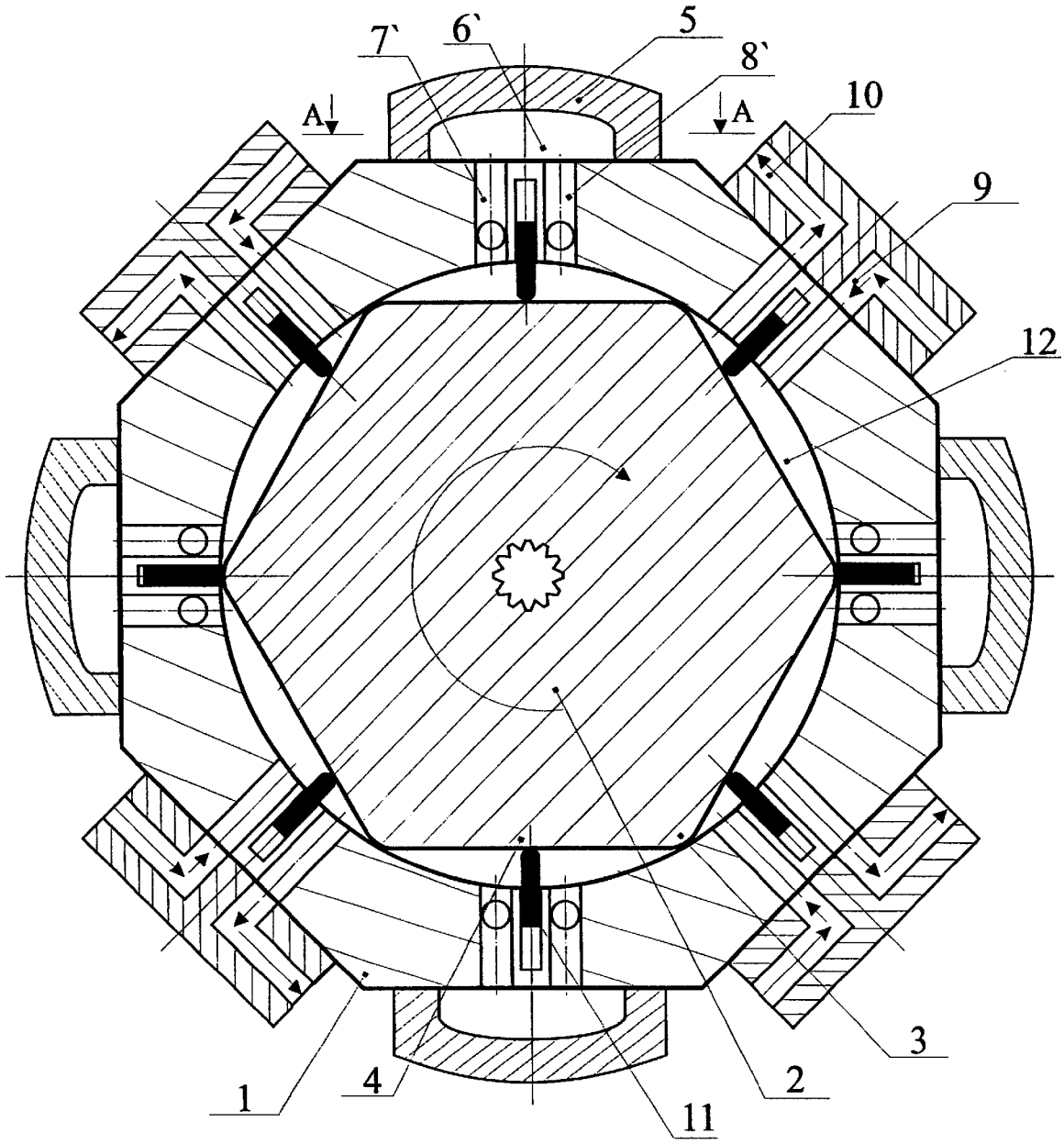

The invention is related to rotary internal combustion engines.

Rotary engines are the alternative to conventional 4-stroke internal combustion engines. Usually a rotor engine contains a rotor-piston, which revolves in a body and feeds air or fuel mixture into a combustion chamber where fuel mixture burns and creates a working stroke by the energy of combustion products.

It is known a rotary internal combustion engine, containing a body with an inner cylindrical cavity with side covers wherein is mounted a rotor-piston with side surfaces, 2 radial protrusions and 2 radial recesses. The said side surfaces of the rotor-piston abut tightly with side covers; radial protrusions of the rotor-piston abut tightly with the inner cylindrical surface of the body cavity. The engine also contain intake and exhaust channels; 2 separating vanes mounted in the inner cylindrical cavity of the body between the inlet and outlet channels and separating vanes, spring-reinforced in the direction of the rotor-piston and located between intake and exhaust channels and so as to be capable of radial displacement (U.S. Pat. No. 3,040,530, 1962). The body is provided with a combustion chamber also. The rotor-piston and separating vanes divide the inner cavity into 4 chambers wherein intake, compression, working and exhaust strokes take place.

The disadvantage of this engine is the presence of considerable friction between separating vanes and rotor surface that leads to intensive wear of the surfaces and, as a consequence, decreases the service life of the engine.

The nearest prior art of our invention is the rotary internal combustion engine containing a body with an inner cylindrical cavity and side covers. A rotor-piston is mounted concentrically in the cavity. The rotor-piston has side surfaces, 2 radial protrusions and 2 radial recesses. The side surfaces abut tightly with the side covers; radial protrusions of the rotor-piston abut tightly with the inner cylindrical surface of the body cavity. The combustion chamber is located beyond the limits of the inner cylindrical cavity and is communicated with it through inlet and outlet channels, provided with controlled slide valves. The engine also contains intake and exhaust channels, 2 separating vanes, mounted in the inner cylindrical cavity of the body between the inlet and outlet channels and between intake and exhaust channels so as to be capable of radial displacement. (U.S. Pat. No. 3,579,733, 1996). The separating vanes of the engine define together with radial hollows of the rotor piston, with inner surface of the cylindrical body cavity and with side covers working chambers. The engine is provided with a separating vanes control mechanism, which moves the separating vanes synchronously with rotor rotation so that to ensure their tight contact with the rotor surface but without considerable mechanical load on contacting surfaces.

When this engine is in operation the following takes place simultaneously a working stroke in the working chamber, adjacent to the combustion chamber; intake stroke in the next working chamber (in the direction of rotor rotation); compression stroke in another working chamber, adjacent to the combustion chamber and exhaust stroke in the working chamber, previous to it. As soon as pressure in the working chamber, where the working stroke takes place, equals the pressure in the working chamber, where compression stroke goes on, the outlet channel of the combustion chamber closes and the inlet channel opens at the same time. At this moment discharging of the combustion chamber is not yet completed and there is excess pressure wherein it. It means that the further compression of air or fuel mixture is achieved by the rotor's deceleration and a new portion of fuel mixture will be contaminated by the combustion products left after the last combustion cycle. As a result, a noticeable nonuniformity of torque can be observed as well as the decrease in power efficiency of the engine in general due to deterioration of mixture combustion in the combustion chamber.

A purpose of the present invention is to the elimination of these disadvantages and to provide a rotary internal combustion engine wherein the compression stroke will be taking place in a combustion chamber cleared off the products of combustion practically completely under the initial pressure equal to or close to the ambient pressure, i.e. atmospheric pressure.

According to the present invention there is provided a rotary internal combustion engine containing:

a body with an inner cylindrical cavity with side covers wherein is mounted concentrically a rotor-piston with side surfaces, radial protrusions and radial recesses on the periphery surface, defining together with the body segment chambers. The side surfaces of the rotor-piston abut tightly with the side frames; radial protrusions of the rotor-piston abut tightly with the inner cylindrical surface of the body cavity;

a combustion chamber located beyond the limits of the inner cylindrical cavity and communicates with it through inlet and outlet channels provided with controlled slide valves;

exhaust and intake channels;

separation vanes which are connected to a control mechanism and mounted so as to be capable of radial displacement in the grooves of the body and in the grooves of the inner surfaces of the side covers between the inlet and outlet channels of the combustion chambers as well as between the discharge and supply channels and brought into contact with the periphery surface of the rotor-piston to define together with the radial resesses of the rotor-piston, with the inner surface of the cylindrical body and with the side covers of the body segmented working chambers;

the further provide with second combustion chamber, identical to the first one and isolated therefrom. The first combustion chamber communicates with the inner cylindrical cavity through a first inlet and a first outlet channels provided with controlled slide valves, while the second combustion chamber communicates with the inner body cylindrical cavity through the second inlet and the second outlet channels provided with controlled slide valves.

The combustion chambers operate in opposite phases: while fuel mixture burns in the first chamber and the products of combustion produce the working stroke, the second chamber is being filled with a fresh portion of air or a fuel mixture. After completing of the working stroke, the first chamber is communicated with the ambient atmosphere through of the corresponding working chamber and the exhaust channel, being cleared off the combustion products practically completely. After that it begins to be filled with a new portion of air or fuel mixture while the compressed fuel mixture in the second chamber ignites.

In order to provide equal working conditions for both chambers angular coordinates of the first and the second inlet channels of the combustion chambers are equal, and angular coordinates of the first and the second outlet channels of the combustion chambers are equal. At the same time the angular coordinates of the intake and exhaust channels are also the same.

In a most preferable embodiment the engine contains a rotor-piston with 6 radial protrusions and 6 radial recesses and 8 combustion chambers.

In general, the engine contains a rotor-piston with N radial protrusions and N radial recesses and n combustion chambers provided that $N \geqq 4$ and $n \geqq 4$.

Figure 2:
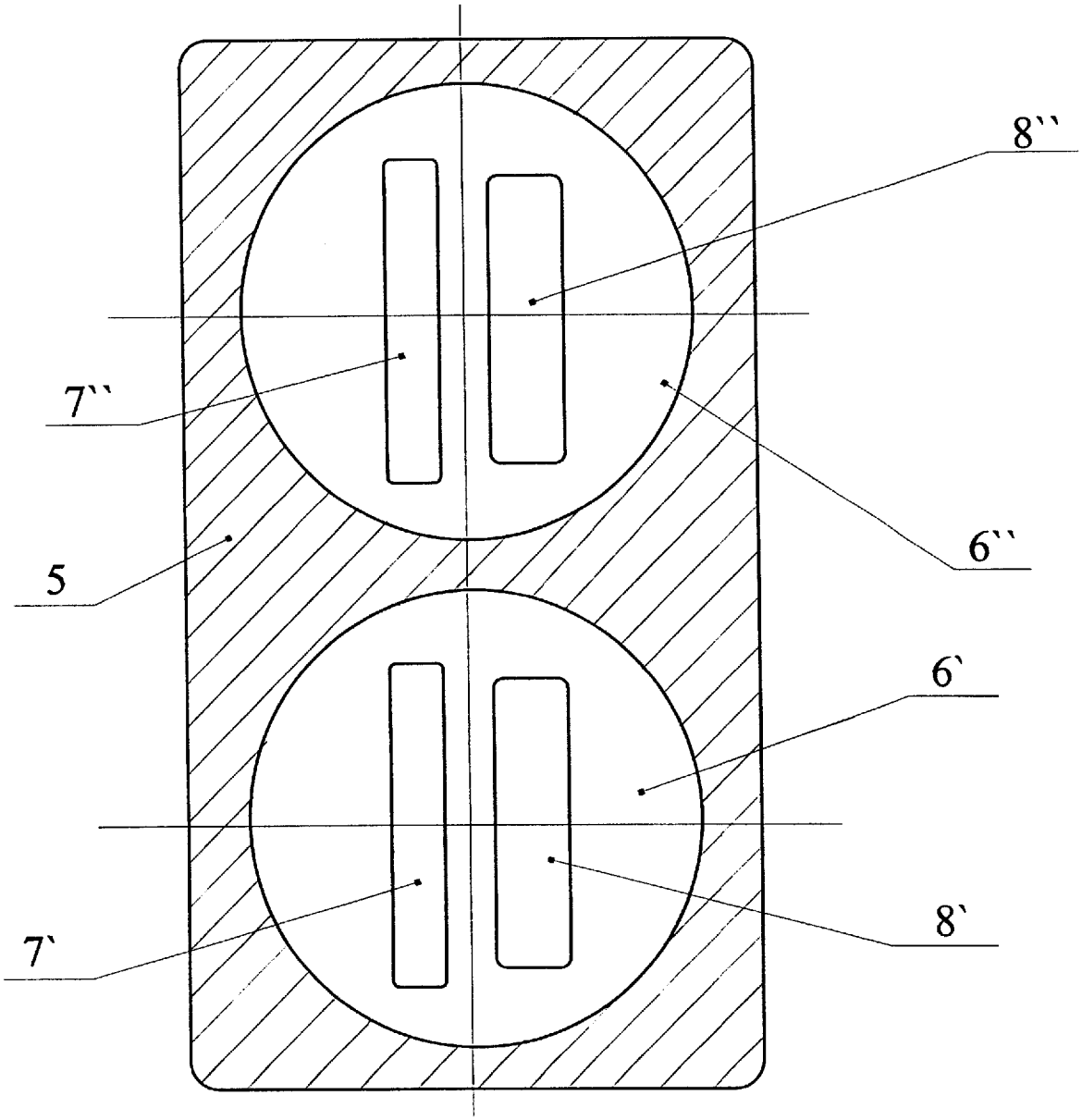

More detailed the invention is explained by means of drawings wherein an engine with 6 segment chambers and 4 pairs of combustion chambers is shown:

FIG. 1—cross-section of the engine;

FIG. 2—section A—A of the combustion chambers.

The engine consists of the body 1 with an inner cylindrical cavity and side covers (not shown on the drawings)—FIG. 1. The rotor-piston 2 is mounted concentrically in the cylindrical cavity of the body 1 and has side surfaces, radial protrusions 3 and radial recesses 4. Side surfaces of the rotor-piston abut tightly with the side covers; radial protrusions 3 of the rotor-piston 2 abut tightly with the inner surface of the cylindrical cavity of the body 1.

On the body 1, beyond the limits of the cylindrical cavity 4, pairs 5 of combustion chambers 6' and 6" are mounted along the circumference at a regular interval and provided with the channels for fuel injection (FIG. 2). The chamber 6' is communicated with the inner cylindrical body cavity through the first inlet 7' and the first outlet 8' channels. The chamber 6" is communicated with the inner cylindrical cavity of the body through the second inlet 7" and the second outlet 8" channels.

To ensure the equivalent conditions of work for both chambers 6' and 6" the angular coordinates of the first inlet channel 7' into the inner cylindrical cavity of the body 1 and the angular coordinates of the second inlet channel 7" into the inner cylindrical cavity of the body 1 coincide in general as well as the angular coordinates of the first outlet channel 8' into the inner cylindrical cavity of the body 1 and the angular coordinates of the second outlet channel 8" into the inner cylindrical cavity of the body 1, which coincide in general too.

Opening and closing of inlet 7 and outlet 8 channels are carried out depending on angle of revolution of the rotor-piston 2 and according to the set algorithm, e.g. by means of valve gears which can be either traditional or any other and which are not described in the present application.

The body 1 is provided with intake 9 and exhaust 10 channels which are located pairwise along the circumference of the casing 1 between the pairs 5 of combustion chambers at a regular interval.

Separating vanes 11, able to shift radially, are mounted in the grooves of the body 1 between the inlet 7 and outlet 8 channels. These vanes 11 abut tightly the periphery surface of the rotor-piston and are mounted in the grooves of the body and in the side covers. As a result, they divide together with radial hollows 4 of the rotor-piston 2, the inner surface of the cylindrical cavity of the body 1 and with the side covers of the body 1 the chambers 12 into two parts.

The control of the separating vanes is carried out by means of the mechanism which lifts and lowers them according to the angle of revolution of the rotor-piston 2 in such a manner as to ensure their sliding along the radial protrusions 3 and radial recesses 4 of the rotor 2, securing the separation of the adjacent working cavities with minimal leaks. This mechanism can be traditional or any other and is not described in the present application.

Besides, the engine is provided with the usual systems ensuring its proper operation: fuel-feeding carburetor or injection system, lubrication, electrical, exhaust and other systems and devices, which are typical for internal combustion engines and not described in the present application.

At last, the described engine can be one of the several modules of an engine, which consists of several such modules, having a common shaft and other auxiliary systems.

In simplified manner, the engine operates as follows. The rotor-piston 2 rotated in the cylindrical cavity of the body 1 and the separating vanes slide along its protrusions 3 and recesses 4. As a result volumes of all working cavities changes cyclically from the minimum value to maximum value. At any moment of time in one of the chambers of each pair 5 of combustion chambers fuel mixture burns. The products of combustion under high pressure through the opened outlet channel 8 flow into the next chamber 12 behind the separating vanes 11, where a torque applied to the rotor-piston is being created due to the presence of tangential component of pressure of the products of combustion. In other words, in the given chamber a working stroke takes place. Inlet channel 7 of this chamber is closed at this moment. Similar processes take place in the opposite combustion chambers and create a force couple of the torque.

At the same time, the other chamber of this pair of combustion chambers through the opened inlet channel 7 is force-fed with fresh fuel mixture from the working cavity, located before this combustion chamber. The outlet channel of this chamber is closed at that time, i.e. a compression stroke takes place in this chamber. When the volume of this working cavity reaches minimum, i.e. at the end of a compression stroke, in the adjacent working cavity the working stroke is completed and the cavity is communicated with the exhaust channel 10 which discharges waste gases. Simultaneously, the inlet 7 channel of this other chamber closes. Then fuel mixture, compressed in this other chamber, ignites; the outlet channel 8 of this chamber opens and now the working stroke takes place in the second chamber and in the working cavity, connected therewith.

Similarly, the reversal of slide valves in the first chamber is carried out, i.e. the inlet channel 7 opens and the outlet pot 8 closes and fresh fuel mixture is force-fed into this first chamber. Ingestion of fresh fuel mixture into the working cavities takes place after the radial protrusions 3 passed the separating vanes 11, located between the intake 9 and exhaust 10 channels.

The embodiment of the engine, shown in the FIG. 1, has 6 radial protrusions, 6 radial recesses and 4 pair of combustion chambers. During one complete revolution of the rotor-piston take place 12 doubled working strokes with the displacement of 30°. For the sake of comparison: in a 6-cylinder 4-stroke engine of internal combustion 3 working strokes with the displacement of 120 take place during one complete revolution of the crankshaft. In the known rotor-piston engine (U.S. Pat. No. 3,579,733), 2 working strokes take place during one complete revolution of the shaft. Consequently, the engine according to present invention will ensure higher regularity of the torque.

Besides, unlike the engine of U.S. Pat. No. 3,579,733, each chamber of the pair of combustion chambers communicates with the exhaust channel at the end of the working stroke and in the result of that the pressure of waste gases wherein is near to the atmospheric pressure. So, the power, required for compression of fresh portion of fuel mixture will be reduced when compared with the engine of U.S. Pat. No. 3,579,733. At the same time, the contamination of fresh mixture with the products of combustion will be lower that favors fuel combustion and increases the power efficiency of the engine of this invention.

What is claimed is:

1. A rotary internal combustion engine, comprising:

a body with an inner cylindrical cavity, and having a first inlet channel, a first outlet channel, a second inlet channel, a second outlet channel, an exhaust channel and an intake channel disposed therein;

side covers;

a rotor-piston concentrically mounted in the inner cylindrical cavity, and having side surfaces, and having a periphery surface with radial protrusions and radial recesses thereon, said rotor-piston forming together with said body, segment cavities, the side surfaces of said rotor-piston abutting tightly against said side covers, said radial protrusions abutting tightly against an inner cylindrical surface of said body which defines the inner cylindrical cavity;

at least one pair of combustion chambers, including a first combustion chamber, and a second combustion chamber which is identical to said first combustion chamber and isolated therefrom, said first combustion chamber communicating with the inner cylindrical cavity of said body through the first inlet channel and through the first outlet channel, said second combustion chamber communicating with said inner cylindrical cavity of said body through the second inlet channel and through the second outlet channel, each of the first inlet channel, the first outlet channel, the second inlet channel and the second outlet channel having a controlled valve;

a control mechanism;

a first separation vane mounted between the inlet channels of the pair of combustion chambers and the outlet channels of the pair of combustion chambers, and being connected to said control mechanism so as to radially displace in grooves formed in said body and in grooves formed in inner surfaces of said side covers; and a second separation vane mounted between the exhaust channel and the intake channel and being connected to said control mechanism so as to radially displace in further grooves formed in said body and in further grooves formed in the inner surfaces of said side covers, said first and second separation vanes being brought into contact with the periphery surface of the rotor-piston to define together with said radial recesses of said rotor-piston, with said inner cylindrical surface of said body and with said side covers, segmented working chambers.

2. The rotary internal combustion engine according to claim 1, wherein said rotor-piston comprises 6 radial protrusions, 6 radial recesses and 4 pairs of combustion chambers.

3. The rotary internal combustion engine according to claim 1, wherein said rotor-piston comprises N radial protrusions, N radial recesses and n combustion chambers provided that $N \geqq 4$ and $n > N$.

* * * * *